US007354146B2

(12) United States Patent
Yraceburu et al.

(10) Patent No.: US 7,354,146 B2
(45) Date of Patent: Apr. 8, 2008

(54) DRYER

(75) Inventors: Robert M. Yraceburu, Camas, WA (US); Bryan Bihlmaier, Vancouver, WA (US); Stephen McNally, Vancouver, WA (US); David L. Whalen, Vancouver, WA (US); Peter J. Boucher, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 389 days.

(21) Appl. No.: 10/883,921

(22) Filed: Jul. 2, 2004

(65) Prior Publication Data

US 2006/0001721 A1 Jan. 5, 2006

(51) Int. Cl.
*B41J 2/01* (2006.01)

(52) U.S. Cl. ..... 347/102; 347/101; 347/104

(58) Field of Classification Search ..... 347/101, 347/102, 104; 34/92, 304
See application file for complete search history.

(56) References Cited

U.S. PATENT DOCUMENTS 3,814,516 A 6/1974 Whited
4,933,684 A 6/1990 Tasaki et al.
5,020,244 A 6/1991 Smith
5,369,995 A 12/1994 Scheinbeim et al.
5,406,316 A 4/1995 Schwiebert
5,408,381 A 4/1995 Thoma et al.
5,552,862 A 9/1996 Masuda et al.
5,668,589 A 9/1997 Kuwabara et al.
5,712,421 A 1/1998 Raisanen
5,922,939 A 7/1999 Cota
6,055,008 A 4/2000 Bliss
6,073,480 A 6/2000 Gokhfeld
6,168,269 B1 * 1/2001 Rasmussen et al. ..... 347/102
6,176,563 B1 1/2001 Anderson et al.
6,230,543 B1 5/2001 Froehling et al.
6,272,310 B1 8/2001 Blair
6,382,762 B1 5/2002 Therien
6,463,674 B1 * 10/2002 Meyers et al. ..... 34/304
2002/0075371 A1 * 6/2002 Beehler et al. ..... 347/101
2003/0081034 A1 5/2003 Bauer
2004/0109054 A1 * 6/2004 Martin et al. ..... 347/102

OTHER PUBLICATIONS

U.S. Appl. No. 10/848,332, "Humidity Calibration", filed May 17, 2004, Smith,David et al.
Inoue, Satoru et al, "Impinging Jet Dryer", Drying Technology, vol. 10(3), pp. 679-714, 1992.

* cited by examiner

*Primary Examiner*—Lam Son Nguyen

(57) ABSTRACT

Structures and methods are disclosed for at least partially forming an image on a media disposed on a platen, directing air from a dryer at the platen, and circulating the air from the platen back to the dryer.

2 Claims, 5 Drawing Sheets

DRYER

BACKGROUND

Some imaging devices, such as inkjet imaging devices, deposit a liquid, such as ink, on media to at least partially form an image on the media. The media is typically damp or has wet liquid thereon for some period of time after the liquid has been deposited on the media. Wet media can be problematic. For example, wet ink may smear and thereby degrade the image formed on the media. Also, wet media may be more difficult to transport within the imaging device than drier media.

DETAILED DESCRIPTION

Figure 1:
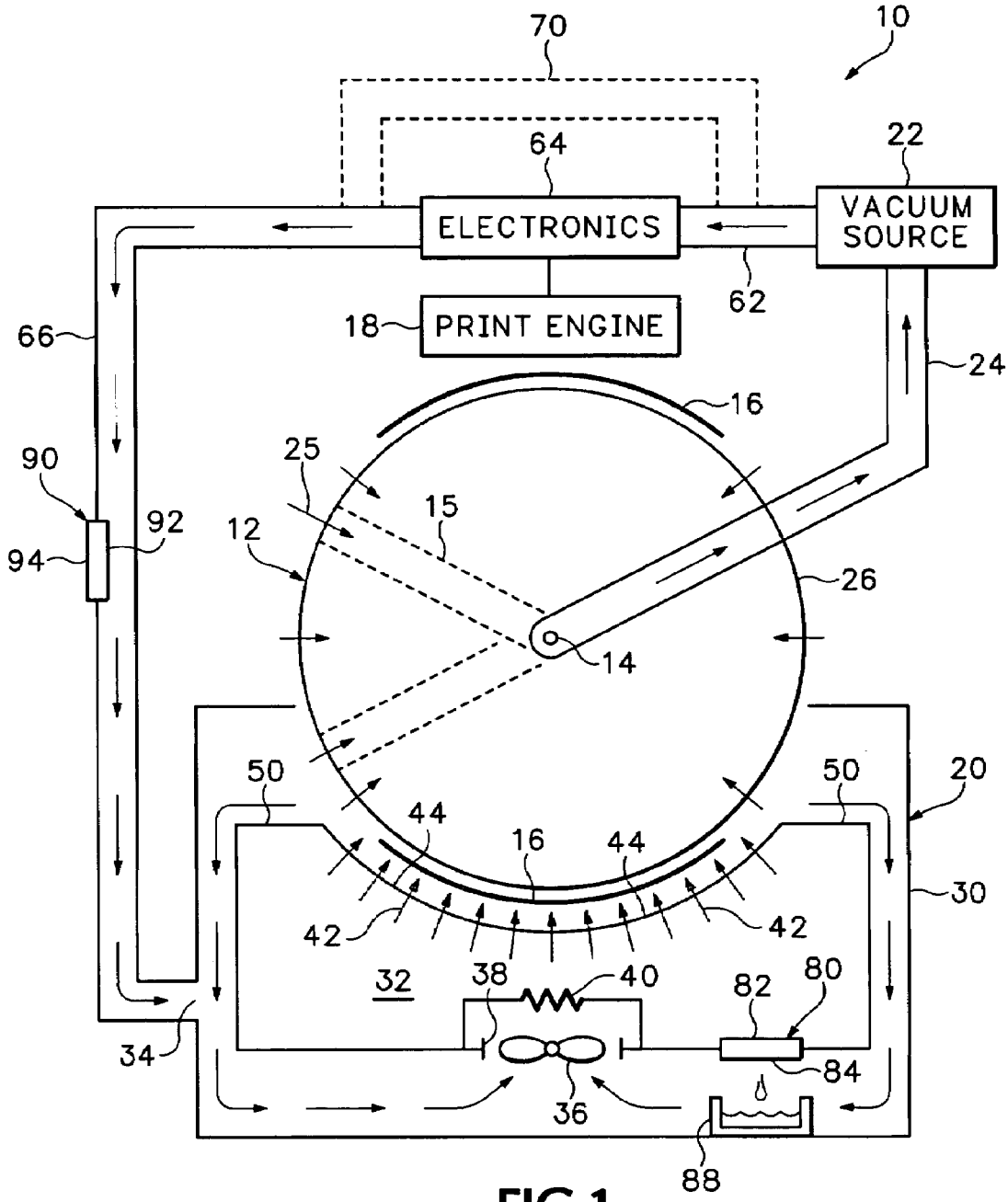
FIG. 1 schematically illustrates an imaging device in accordance with an example embodiment.

FIG. 1 schematically illustrates an imaging device 10 in accordance with an example embodiment. The imaging device 10 includes a drum 12 mounted such that the drum 12 is rotatable about an axis 14. In operation, the drum 12 rotates to advance, or transport, media 16 adjacent a print engine 18 and a dryer 20. The drum 12 serves as a platen to maintain or support the media 16 during imaging and drying. In other embodiments, the drum may be replaced with a belt (not shown). In yet other embodiments (not shown), media is transported by rollers over or adjacent a stationary platen. The drum 12 also serves as a media handling mechanism to advance media 16 through the device 10 and between the print engine 18 and the dryer 20.

When the media 16 is adjacent the print engine 18 (as shown in FIG. 1), the print engine 18 may at least partially form an image on the media 16. In an example embodiment, the print engine 18 may comprise an inkjet print engine configured to eject a liquid, such as ink, onto the media 16 to at least partially form an image on the media 16. The configuration of the print engine 18 may vary. In some embodiments, the print engine 18 includes a plurality of staggered print heads. In other embodiments, the print engine 18 includes a carriage that scans one or more print heads back and forth in a direction orthogonal to the direction of media movement during printing. Electronics 64 are coupled to the print engine 18 and may be configured as a power supply to supply power to the print engine 18. The electronics 64 may include a heat sink or heat exchange structure for transferring heat from the electronics.

When the drum 12 is rotated such that the media 16 is adjacent the dryer 20, ink on the media is at least partially dried by air exiting the dryer 20. The dryer 20 directs air toward the drum 12 to assist in the drying of media thereon.

In the example embodiment of FIG. 1, the media 16 is maintained on the drum 12 by vacuum hold down. The vacuum hold down may be generated by vacuum source 22, such as an air handling device. For example, the vacuum source 22 may comprise a blower. The vacuum source 22 is shown in FIG. 1 as being coupled to the drum 12 by a conduit 24. The conduit 24 may comprise a tube, passageway, cavity, pipe, duct, or other suitable structure for fluidly coupling the drum 12 and the vacuum source 22. The drum 12 has internal structure 15 (shown in dotted lines) that fluidly couples the conduit 24 with holes 25 formed in the outer surface 26 of the drum 12 such that a partial vacuum is created at the outer surface 26. This partial vacuum holds the media 16 against the surface 26 of the drum 12 by suction force during imaging and drying.

The dryer 20 is positioned adjacent the drum 12 and, in some embodiments, blows or otherwise directs air, such as heated air, toward the drum 12 to increase or accelerate drying of media 16 on the drum 12. The example embodiment shown in FIG. 1 illustrates that, according to some embodiments, the dryer 12 may comprise an outer chamber 30 and an inner chamber 32. The inner chamber 32 is disposed in the outer chamber 30. The outer chamber 30 includes an inlet 34 at which air passes from a duct 66 into the outer chamber 30. The inner chamber 32 includes an inlet 38 at which air passes from the outer chamber 30 into the inner chamber 32. An air handling device 36 is shown as being disposed at the inlet 38 of the inner chamber to pressurize the chamber 32 using air from the outer chamber 30. In other words, the air handling device 36 advances air from the chamber 30, through the inlet 38 into the chamber 32. Further, in some embodiments, the air handling device 36 also helps to draw air through the duct 66 into the outer chamber 30. The air handling device 36 may comprise, for example, a blower, a fan, or other suitable device.

A heating element 40 is optionally disposed at the dryer 20. In the example embodiment shown in FIG. 1, the heating element 40 is an electric resistive heating element and is disposed adjacent the inlet 38 and within the chamber 32. Other suitable types of heating elements may be alternatively employed. The power delivered to the heating element 40 may be controlled and varied by a controller (not shown) based on factors such as temperature, humidity, image density, throughput speed, or the like. In other embodiments, the heating element 40 may be disposed in the outer chamber 30. The heating element 40 may be employed to heat air as the air passes over the heating element and before the air exits the inner chamber 32. Raising the temperature of the air may aid drying of the media in some applications.

Holes 42 are also formed in a surface 44 of the inner chamber 32. The holes 42 serve as air passages to permit the air contained in the inner chamber 32 to pass through the holes 42 and impinge or otherwise be directed toward the drum surface 26. In some embodiments, at least some of the holes 42 are formed as nozzles.

In this configuration, the media 16 advances into a region between the surface 26 of the drum and the surface 44 of the inner chamber 30 of the dryer 20 and air is expelled from the holes 42 so as to contact or impinge the media 16. The air expelled from the holes 42 is typically warmer than ambient air outside of the device 10. In some embodiments, the air expelled from the holes 42 is significantly warmer than the ambient air. Pursuant to some embodiments, the air expelled from the holes 42 is circulated and/or re-circulated back into the inner chamber 32 through one or more air paths.

One of the air paths shown in FIG. 1 includes air exiting one or more of the holes 42, passing around an end 50 of the inner chamber 32, re-entering the outer chamber 30 and then passing back into the inner chamber 32 through the inlet 38 under the influence of the air handling device 36. Re-circulating air in this fashion may result in reduced or lowered power usage of the heating element 40 because the air passing by the heating element 40 may already be warmer than ambient. In some embodiments, it may be desirable to closely position the drum and the dryer to reduce the amount of air that escapes the region between the extensions 144 of the outer chamber and the surface 26 of the drum 12.

Another of the recirculation paths shown in FIG. 1 includes air exiting one or more of the holes 42, being drawn into one or more of the holes 25 formed in the surface 26 of the drum 12, passing through the drum 12 into the conduit 24, through the vacuum source 22, through the conduit 62, over the electronics 64, and through duct 66 to the chamber 30 via the inlet 34. As the air passes this recirculation path, the air may be heated by heat expelled by a motor (not shown) of the vacuum source 22 and may be further heated by the electronics 64. In many embodiments, the temperature of the air passing over or through the electronics 64 is cooler than the temperature of the electronics. As such, as the air passes through, or over the electronics 64 the air cools the electronics and the electronics heat the air as thermal energy is transferred from the electronics to the air. While not illustrated in FIG. 1, the electronics 64 may include one or more heat transfer devices, such as thermally conductive fins, pins or the like to facilitate heat transfer between the electronics 64 and the air passing through or over the electronics.

As shown by the optional conduit 70 shown in dashed lines in FIG. 1, passage of the air across the electronics 64 is optional and the air may, instead, pass through the conduit 70 instead of or in addition to passing through the electronics 64. That is, the air may bypass the electronics 64 and advance directly from the vacuum source 22 to the inlet 34.

It should also be noted that some ambient temperature air may also enter the holes 25 and pass through the drum 26 into the conduit 24, through the vacuum source 22, through the conduit 62, electronics 64, and duct 66 to the chamber 30 via the inlet 34. This air may be heated by one or more of the vacuum source 22 and the electronics 64.

A portion of the air received at the vacuum source 22 via conduit 24 may be expelled by the vacuum source 22 to ambient rather than being advanced into the conduit 62. In some embodiments, the quantity of air received at the vacuum source 22 is greater than that needed at inlet 34. As such, in some embodiments, less than all of the air received at the vacuum source 22 is expelled into the conduit 62. The vacuum source 22 may include a port (not shown) for the expiration of this air. Optionally or additionally, in some embodiments excess air may be expelled via ports in one or more of the conduits 62, 70, 66.

According to another aspect, one or more thermoelectric devices, such as Peltier devices, may be used to heat air, to remove moisture from the air, or both. In one embodiment, a thermoelectric device 80 is disposed inside the dryer 20 to remove moisture from air within the dryer 20 using condensation. Removal of moisture from the air may aid in drying in some applications. As shown in FIG. 1, a first side 82 of the thermoelectric device 80 is exposed to the chamber 32 and the second side 84 of the thermoelectric device 80 is exposed to the chamber 30. In some embodiments, the first side 82 is a hot side of the thermoelectric device 80 and the second side 84 is a cold side. The second side 84 may be maintained at a temperature that is at or below the dew point of the air in the chamber 30. Heat transfer devices (not shown), such as pins, fins, or other suitable structure may be coupled to the first side 82 and/or the second side 84 of the thermoelectric device 80 to aid in transferring heat between the air and the thermoelectric device. Use of a thermoelectric device is optional and may not be present in all embodiments.

Pursuant to some embodiments multiple thermoelectric devices 80 may be employed. In operation, air is warmed as the air passes over the first side 82 of the thermoelectric device 80, and the air is then pushed through holes 42 to the media and removes some quantity of moisture from the media 16. The warm moist air may then be re-circulated back to the outer chamber 30 and may pass over the second side 84 of the thermoelectric device 80. As the air passes over the second side 84 of the thermoelectric device 80, some of the moisture in the air may condense on the relatively cold surface of the second side 84 (or associated heat transfer structure) of the thermoelectric device 80, if the temperature of the second side 84 is at or below the dew point of the warm moist air. This moisture then drips into collector 88 and may be removed from the dryer 20. The collector 88 may be disposed in the chamber 30 and beneath the second side 84 of the device 80. After moisture from the air has been thus extracted, the air passes through the inlet 38 to the inner chamber 32. Reducing the moisture of the air may aid in drying in some embodiments. The use of a thermoelectric device is, of course, optional in some embodiments.

Another aspect provides an optional thermoelectric device 90 to further heat circulating air. FIG. 1 illustrates the device 90 as being disposed along the duct 66 with a first side 92 exposed to the interior of duct 66 and a second side 94 exposed to ambient. The first side 92 is a hot side and the second side 94 is a cold side. The location of the device 90 may vary. In some embodiments, the second side 94 may be adjacent or thermally coupled to the electronics 64 to cool the electronics 64 and to re-capture some of the heat generated by the electronics 64 to heat the circulating air. In one embodiment, the thermal coupling of the second side 94 to the electronics may be by one or more thermally conductive members (not shown) or materials disposed between the second side 94 and the electronics 64. The first side 92 of device 90 warms the air passing through the duct 66. Using a thermoelectric device may result in a heat output greater than the electrical power input to the device 90 due to heat captured at the second side 94. Use of the thermoelectric devices 80, 90 is optional in some embodiments.

Figure 2:
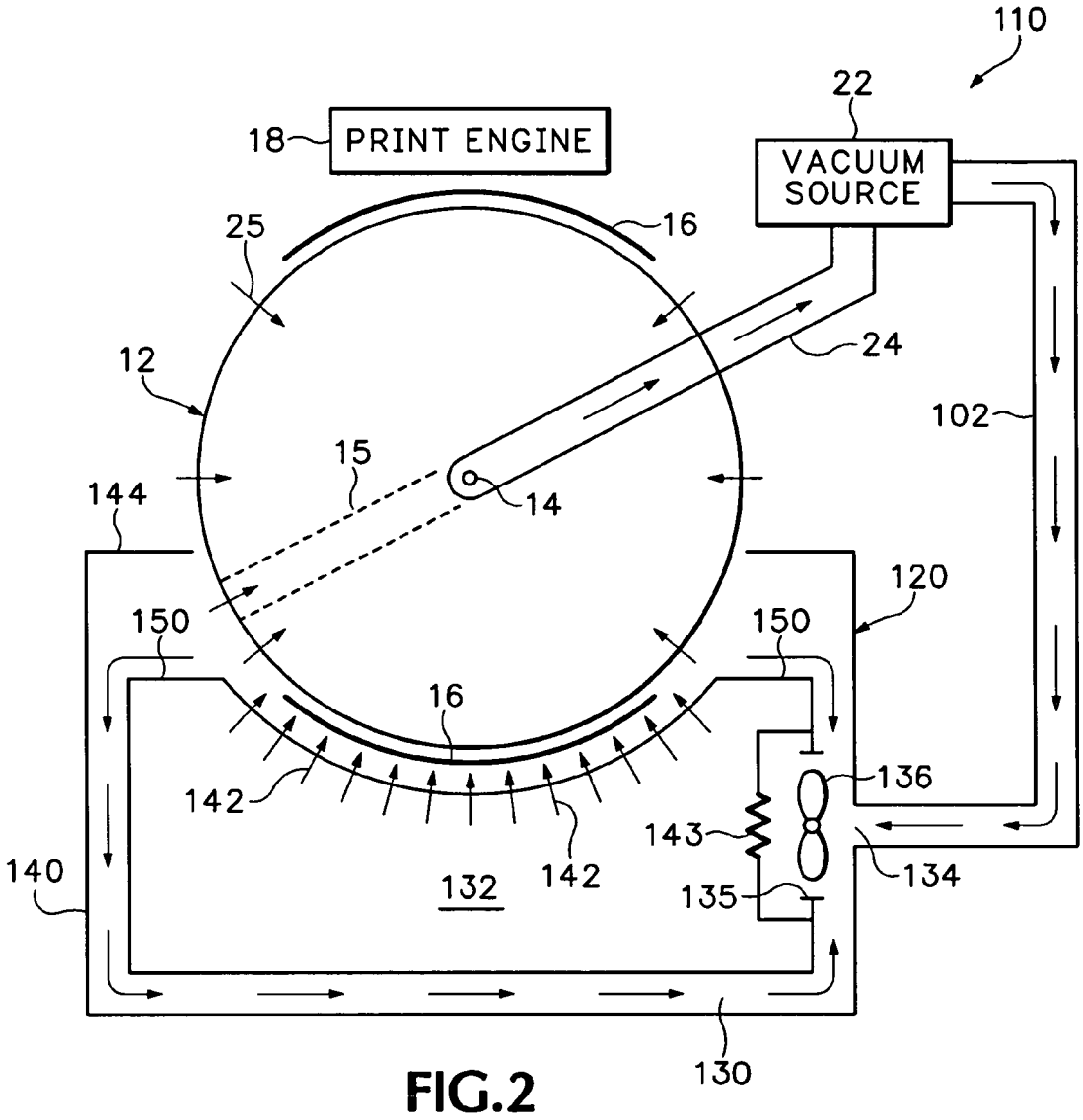
FIG. 2 schematically illustrates an imaging device in accordance with another example embodiment.

FIG. 2 illustrates an imaging device 110 in accordance with another embodiment. The imaging device 110 is similar to the device 10 shown in FIG. 1 and described above. The device 110 includes a drum 12, a vacuum source 22 and a print engine 18 configured as described above with respect to FIG. 1. A dryer 120 includes an inner chamber 132 disposed within an outer chamber 130. A duct 102 directs air from an outlet of the vacuum source 22 to an inlet 134 of the outer chamber 130. An air handling device 136 advances air from the outer chamber 130 to the inner chamber 132 via inlet 135 and pressurizes the inner chamber 132 such that air within the inner chamber 132 is directed through holes 142 formed in the inner chamber 132. The outer chamber 130 is defined by a wall 140 that includes extensions 144. The extensions 144, in some embodiments, are positioned close to the drum and may assist in directing air from the holes 142, around ends 150, back into the outer chamber 130.

At least two distinct air paths for circulating or re-circulating air are illustrated in FIG. 2. Air travels a first path by exiting the holes 142, entering holes 25 of the drum 12, passing to vacuum source 22 along conduit 24, exiting the vacuum source 22 and passing through duct 102, entering the outer chamber 130 at inlet 134 and then passing to the inner chamber 132 through inlet 135. Air may alternatively travel a second path by exiting the holes 142, passing around ends 150 and re-entering the inner chamber 132 via the inlet 135. A heating element 143 may be positioned adjacent the inlet 135 to heat air. In some embodiments, a portion of the air exiting the holes 142 advances along the first path and another portion of the air exiting the holes 142 advances along the second path.

It should also be noted that some ambient temperature air may also enter the holes 25 and pass through the drum 12 into the conduit 24, through the vacuum source 22, and into the chamber 30 via the inlet 34. Alternately, this air may exit the conduit 102 or the dryer 120 and be expelled to ambient.

Figure 3:
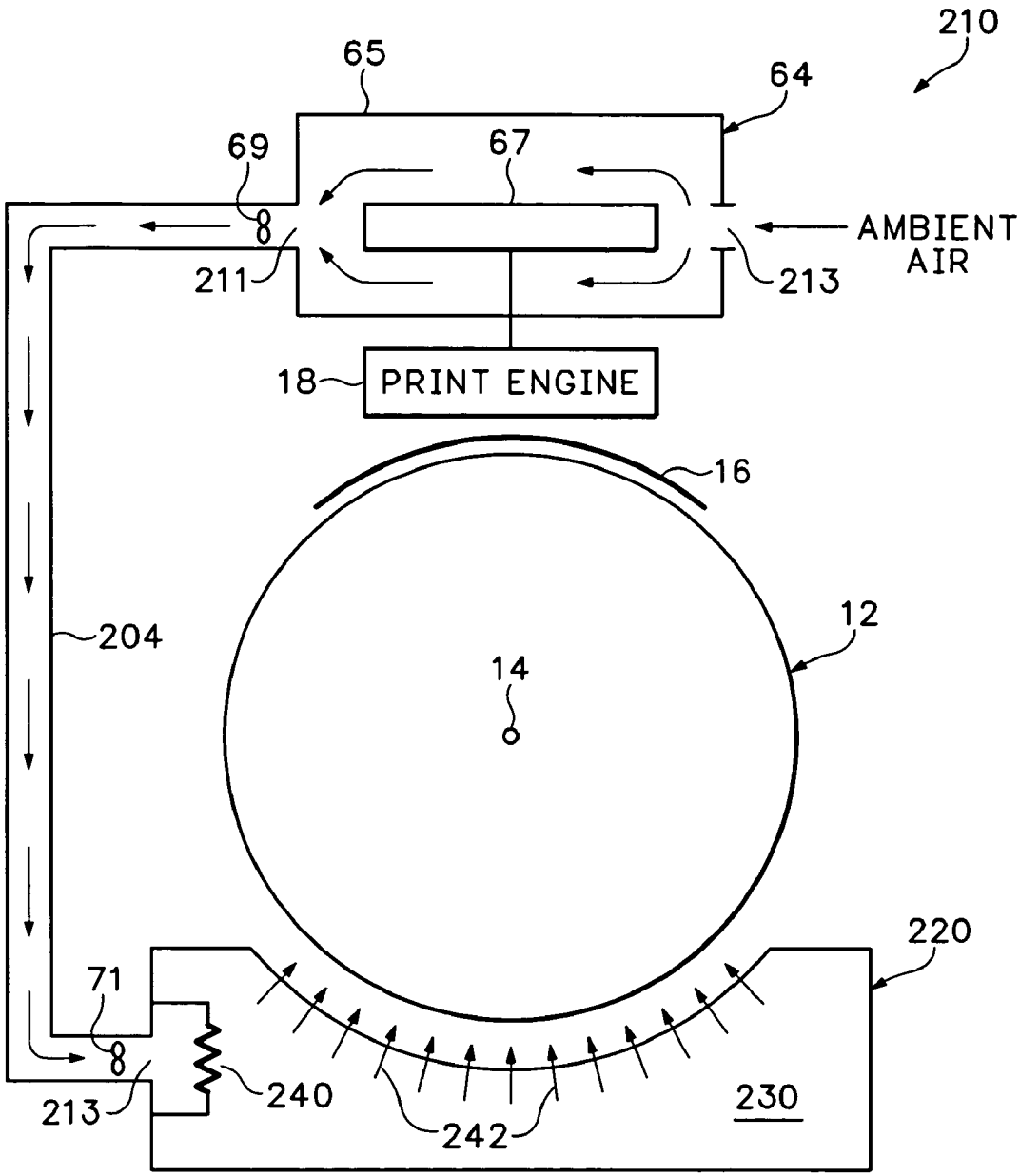
FIG. 3 schematically illustrates an imaging device in accordance with another example embodiment.

FIG. 3 illustrates imaging device 210 in accordance with another example embodiment. The device 210 is similar to the device 10 of FIG. 1 in that the device 210 includes a drum 12, print engine 18, and electronics 64. The media 16 may be held to the drum 12 by electrostatic hold down, vacuum hold down, or both, or through some other means. An air handling device 69 draws air from around the electronics 64 and advances the air into a duct 204. Ambient air is heated by the electronics 64 before entering into the duct 204.

In one embodiment, the electronics 64 comprise a housing 65 and the ambient air passes into the housing 65, over electronic components 67 (which may include a heat sink), and out of the housing 65 under the influence of an air handling device, such as device 69. The device 69 is shown as positioned at an outlet 211 of the housing 65, but may alternatively be positioned at an inlet 213 of the housing 65. In some embodiments, the device 69 is optional and the air is advanced under influence of air handing device 71 positioned at an inlet 213 of a dryer 220. The dryer 220 includes a chamber 230 into which the air heated by the electronics 64 is advanced. A heating element 240 may further heat the air at the dryer 220. Air within the chamber 230 of the dryer 220 is then directed toward the drum 12 via holes 242 formed in the dryer. This air may be used to assist in drying ink on the media 16 as the media 16 passes adjacent the dryer 220.

Figure 4:
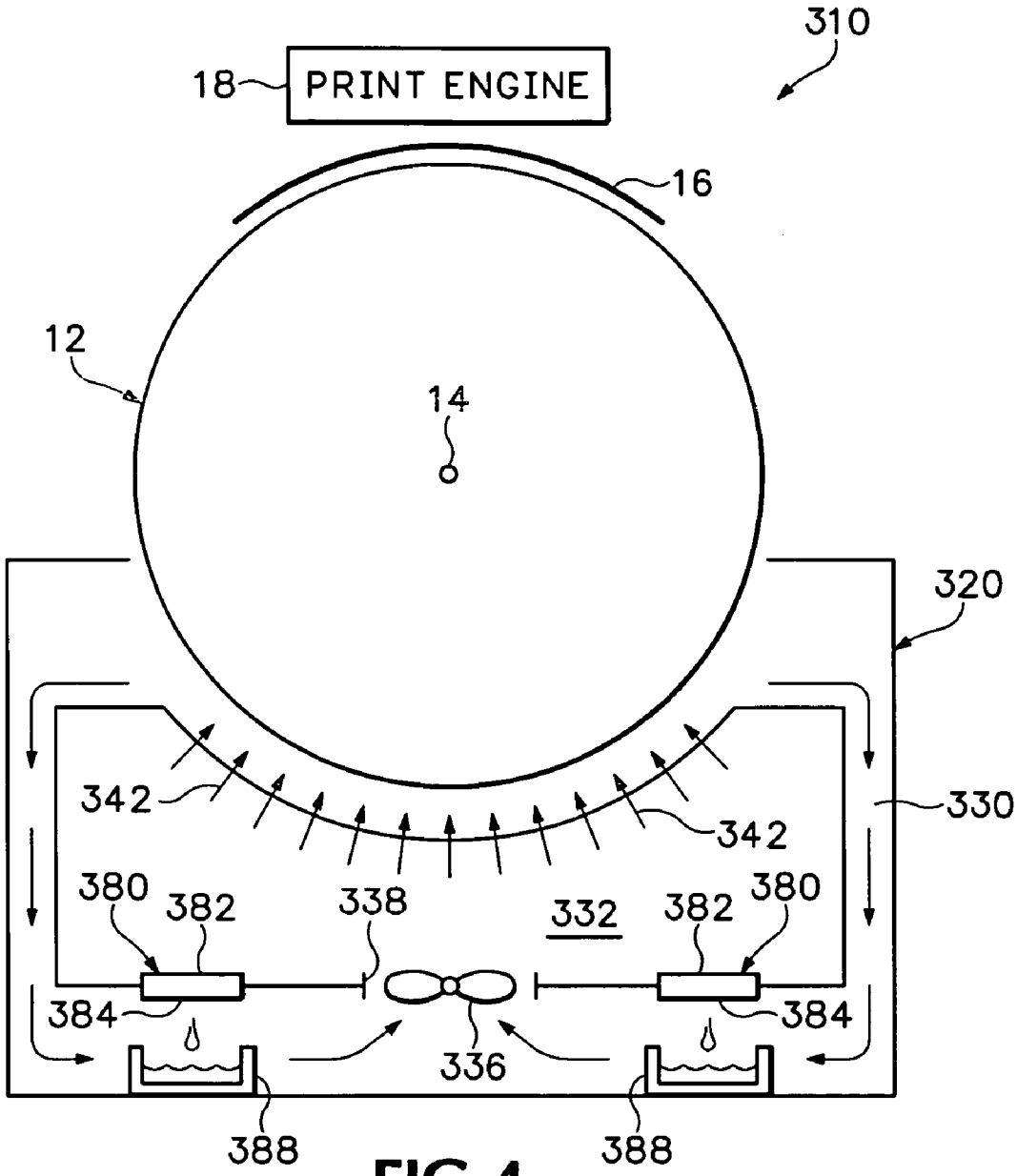
FIG. 4 schematically illustrates an imaging device in accordance with another example embodiment.

FIG. 4 illustrates an imaging device 310 in accordance with another embodiment. The embodiment shown in FIG. 4 is similar to the device 10 of FIG. 1 in that the device 310 includes a print engine 18 and a drum 12. A dryer 320 is shown that includes an inner chamber 332 and an outer chamber 330. The inner chamber 332 is within the outer chamber 330. Thermoelectric devices 380 are positioned between the chambers 330, 332 such that first sides 382 of the devices 380 are exposed to the inner chamber 332 and second sides 384 are exposed to the outer chamber 330. The first sides 382 are hot (heat expelling) sides of the devices 380 and the second sides 384 are cold (heat consuming) sides of the device 380. An air handling device 336 is disposed adjacent an inlet 338 to the inner chamber 332 from the outer chamber 330 to advance air from the outer chamber 330 to the inner chamber 332 and to pressurize the inner chamber 332. Holes 342 are formed in the dryer 320 to permit air in the inner chamber 332 to exit the inner chamber toward the drum 12. This air exiting through the holes 342 may aid in the drying of media 16 as the media 16 passes adjacent the holes 342.

The thermoelectric devices 380 heat the air within the inner chamber 332 by expelling heat at the first sides 382. The thermoelectric devices 380 may also, in some embodiments, reduce the moisture in the air in the outer chamber 330 by condensation. In some embodiments, the temperature of the second sides 384 is at or below the dew point of the air in the outer chamber 330. As such, as the air in the outer chamber 330 passes over the second sides (or adjacent heat transfer structures thermally coupled to the second sides), moisture in the air will condense and drip into one of the collectors 388, thereby reducing the moisture in the air in the outer chamber. The moisture may be removed from the dryer 320. Reducing the moisture of the air may be desirable in some drying applications.

Figure 5:
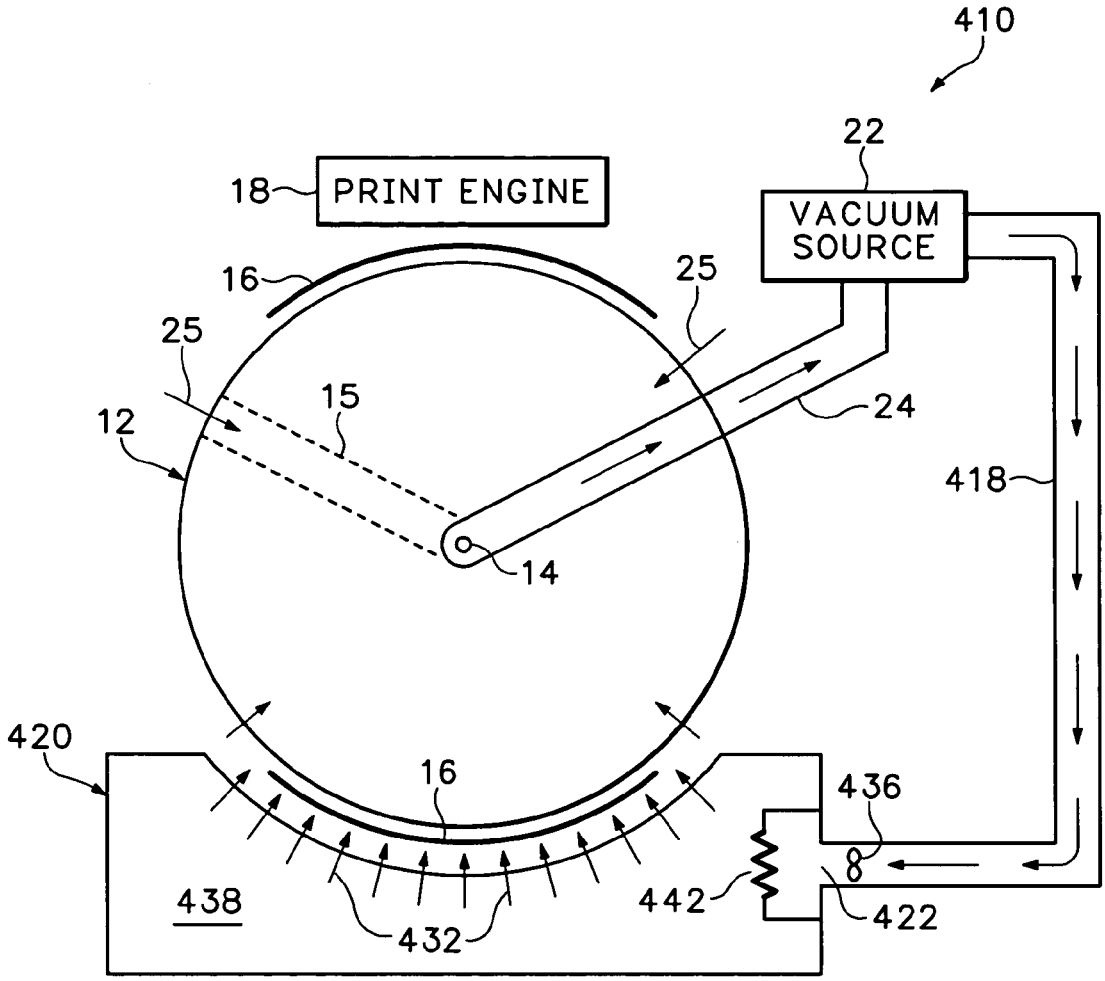
FIG. 5 schematically illustrates an imaging device in accordance with another example embodiment.

FIG. 5 illustrates an imaging device 410 in accordance with another example embodiment. The device 410 is similar to the device 10 described above in that the device 410 includes a drum 12, a print engine 18, and a vacuum source 22. A duct 418 is disposed between and fluidly connects an output of the vacuum source 22 and an inlet 422 of a dryer 420. The dryer 420 also includes an optional air handling device 436 disposed at the inlet 422 to advance air from the duct 418 into a chamber 438 of the dryer 420. The air handling device 436 also pressurizes the chamber 438 such that air within the chamber 438 exits holes 432 toward the drum 12. The air that exits the holes 432 may impinge media 16 disposed on the drum 12 to aid in drying the media 16. An optional heating element 442 may also be disposed within the dryer 420 to heat air within the chamber 438.

In operation, the device 410 draws air, including air exiting the holes 432, through structure 15 to conduit 24 under the influence of the vacuum source 22. This air may be warmer than ambient air because of the presence of some air that has exited the chamber 438 through the holes 432. This air may then be further heated at (or by a motor of) the vacuum source 22. The air then exits the vacuum source 22 into duct 418, which directs the air to the inlet 422 of the dryer 420. The air handling device 436 may aid in directing the air from the vacuum source 22 into the chamber 438. Optionally, the air is further heated by the heating element 442. This air exits the holes 432 toward the drum 12 and may be useful in aiding the drying of media 16. Circulating or re-circulating at least a portion of the air exiting the dryer 420 via holes 432 may increase the heating efficiency of the device 410. Also, heating the air at the vacuum source 22 may also increase the heating efficiency of the device 410.

While several example embodiments have been described above in detail, it will be apparent to those skilled in the art that the disclosed embodiments may be modified. Therefore, the foregoing description is to be considered exemplary rather than limiting.

What is claimed is:

1. An imaging device, comprising:

a print engine;

a platen for supporting media adjacent the print engine;

a vacuum source coupled to the platen for holding media to the platen;

a dryer adjacent the platen for at least partially drying the media;

a conduit for routing air from the vacuum source to the dryer; wherein the dryer further comprises first and second chambers and a thermoelectric device disposed between the first and second chambers such that the thermoelectric device heats air in the first chamber and removes moisture from the air in the second chamber.

2. An imaging device, comprising:

a print engine;

a platen for supporting media;

a dryer adjacent the platen for at least partially drying media;

a thermoelectric device in the dryer, wherein the dryer comprises an inner chamber and an outer chamber, the inner chamber being disposed in the outer chamber, the thermoelectric device being disposed between the inner and outer chambers so that a first surface of the thermoelectric device is exposed to an interior of the inner chamber and a second surface of the thermoelectric device is exposed to an interior of the outer chamber.

* * * * *